United States Patent [19]

Verde

[11] 4,412,697

[45] Nov. 1, 1983

[54] TENNIS BALL RETRIEVING STORAGE CONTAINER

[76] Inventor: John Verde, P.O. Box 31249, Dallas, Tex. 75231

[21] Appl. No.: 255,053

[22] Filed: Apr. 17, 1981

[51] Int. Cl.[3] ..... A63B 47/02

[52] U.S. Cl. ..... 294/19 A

[58] Field of Search ..... 294/19 A, 137, 141-143, 294/167; 56/328 R

[56] References Cited

U.S. PATENT DOCUMENTS

| | | | |
|---|---|---|---|
| 3,371,950 | 3/1968 | Stap | 294/19 A X |
| 3,790,202 | 2/1974 | Nagel | 294/19 A |
| 3,820,836 | 6/1974 | Seewagen et al. | 294/19 A |
| 3,889,996 | 6/1975 | Campbell | 294/19 A |

FOREIGN PATENT DOCUMENTS

| | | | |
|---|---|---|---|
| 2410489 | 8/1979 | France | 294/19 A |
| 7901620 | 9/1980 | Netherlands | 294/19 A |

*Primary Examiner*—Johnny D. Cherry
*Attorney, Agent, or Firm*—Thomas L. Crisman

[57] ABSTRACT

A ball retrieving and storage device including a storage container having a pair of handles hingedly fixed thereto which may be folded to a downwardly extending position supporting the container on a playing surface. The retrieving device includes a plurality of parallel rods extending across the bottom of the container. The rods are spaced apart from one another a distance greater than the diameter of the balls to be retrieved and being slightly resilient in a direction perpendicular thereto. Each of the rods has journaled thereon, for a rotating movement, a hollow, cylindrical tubular roller wherein the distance between inside surfaces of adjacent parallel rollers is slightly less than the diameter of a used tennis ball. The transverse resilience of the rods and the rotating motion of the rollers permit a ball to be retrieved by forcing the bottom of the container down over the ball. When folded upwardly the handles of the container enable an operator to both carry and retrieve balls from a playing surface without bending or stooping. When a substantial number of balls are held within the container, the handles may be folded into a downwardly extending position to support the container at a convenient height for the removal of balls.

2 Claims, 9 Drawing Figures

TENNIS BALL RETRIEVING STORAGE CONTAINER

THE BACKGROUND OF THE INVENTION

1. Field of the Invention

The invention relates to an apparatus for ball retrieval and storage and, more particularly, to a retrieving device having foldable handles and resilient movable rollers forming the bottom of the ball storage container to facilitate ball retrieval.

2. History of the Prior Art

In the teachings and practice of the game of tennis, a substantial number of balls are required for repetitive practice of particular strokes. The student of the game of tennis may quickly find it necessary to utilize a ball container for storage of several tennis balls during a practice session. A conventional bucket container for tennis balls is generally set on the playing surface. It is then necessary to bend or stoop to remove a ball from that container for each practice stroke. While it is possible to set the container on a stand or platform to facilitate the removal of balls for repetitive strokes, such stands and supports for the container comprise more equipment to keep up with. Additionally, such equipment provides obstructions on the playing surface. It would be helpful to provide a ball container which would have means for supporting the container at a convenient height for the removal of balls and, at the same time, provide means for carrying the container conveniently from place to place.

Conventional ball storage devices with handles provided on containers are limited to the single function of carrying the container around. It is generally desirable for the container to be adapted for retrieving these balls from the court surface without an undue amount of bending and stooping. While retrieving tennis balls containers are available, they possess certain inherent disadvantages which the present invention overcomes. For example, one such ball retriever and storage unit incorporates a plurality of parallel relatively unyielding fixed bars forming the bottom of the container. The bars are spaced apart slightly less than the width of a used tennis ball whereby the container may be placed down over the balls which become compressed and squeezed past the bars into the container. One disadvantage of this device is that the relatively unyielding bars of the container will only retrieve balls which are easily compressible when being squeezed past the relatively narrow bars. Further, the repeated impact of these bars and the adjacent container frame portions into a tennis court playing surface causes marring and scarring of the surface. Certain tennis courts incorporate relatively delicate surfaces which cannot withstand such impact without damage.

Similar prior art ball retrieving apparatus is also available which includes movable bars at the bottom of the container. Compression of the container bottom against underlying balls causes a gate to open by slight movement of the bars. Such devices are capable of retrieving a multiplicity of compressible balls upon a playing surface. Most prior art ball retrieving units utilize hard surface engaging frame portions which repeatedly abut the playing surface leading to abrasion thereof. This results in damage to the surface of the playing area and to destructive wear of the ball retrieving unit.

It would be an advantage therefore to overcome the aforesaid problems with an improved tennis ball retrieval unit. The apparatus of the present invention provides such improvements by utilizing a container portion incorporating a bottom formed of transversely resilient rods having journaled thereon cylindrical tubular rollers. The present invention, as further set forth below, also incorporates a foldable handle structure used both in ball retrieval and as a support stand for the ball container portion.

SUMMARY OF THE INVENTION

The invention relates to an improved tennis ball retrieval and storage apparatus. More particularly one aspect of the invention includes apparatus for receiving tennis balls from a playing surface and storing the balls for subsequent use.

The apparatus comprises a container having an open top, side and end walls, and a bottom. The container bottom includes a plurality of parallel rods spaced from one another a distance greater than the diameter of a ball to be retrieved.

A cylindrical roller formed of a resilient material is positioned loosely about each of the bottom rods for movement upon the rods. The spacing between opposing inside surfaces of adjacent ones of the rollers is slightly less than the diameter of a ball to be retrieved and stored within the container.

Means are also provided for supporting the container above balls resting on a playing surface. The forced manipulation of the container downwardly over the balls provides the passage of the balls between adjacent ones of the rollers for retrieval.

In another aspect, the invention includes the tennis ball retrieving apparatus wherein the cylindrical rollers are constructed with a slit along the length of one side for facilitating installation of the rollers onto the rods. The rollers preferably have an inside diameter substantially greater than the diameter of the rods for allowing adjacent rollers to move transversely as well as rotationally relative to the bottom rods during the passage of a ball between adjacent rollers.

The roller may also advantageously depend beneath the container for engaging the playing surface during the downward manipulation of the container. Rollers formed of a resilient material will then not mar a tennis ball playing surface during the use of the container.

In yet another aspect, the invention includes the retrieving apparatus wherein a pair of handles are hingedly mounted to opposite side walls of the container for rotating between an upwardly and downwardly extending position. The handles include elongated hook portions which hingedly connect to the side walls of the container for allowing transverse and rotational movement related to the container. Each of the handles further includes at least one hook member disposed upon the handle for engaging and securing the container through transverse movement of the handle relative to the container. In this manner upstanding support of the container is provided when said handle is in a downwardly rotated position.

A further aspect of the invention includes a method of retrieving tennis balls from a playing surface comprising the steps of providing a container having a bottom portion with a plurality of parallel rods spaced from one another a distance greater than the diameter of the balls to be retrieved. At least one roller is provided on each of the rods with the spacing between opposing inside surfaces of adjacent ones of the rollers being slightly less than the diameter of a ball to be retrieved. The container is then positioned over balls to be retrieved upon the playing surface and the container is moved downwardly over the balls to be retrieved and then engaged between adjacent rollers for the passage of the balls into the containers. Adjacent rollers are then allowed to rotate with the passage of the balls into the container.

BRIEF DESCRIPTION OF THE DRAWINGS

Additional features and advantages of the present invention will be apparent from the following description of the preferred embodiment taken in conjunction with the accompanying drawing in which.

DETAILED DESCRIPTION

Figure 1:
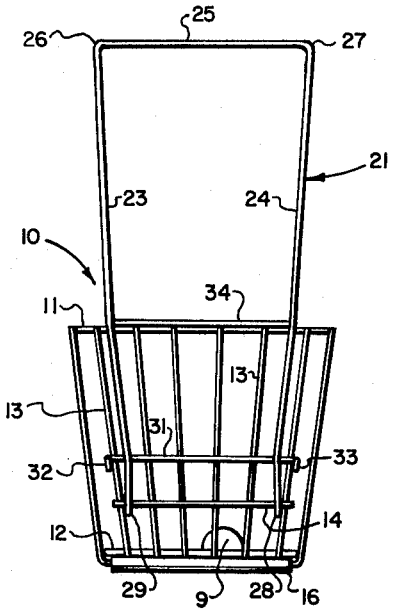
FIG. 1 is a side elevational view of one embodiment of the apparatus of the present invention, including foldable handles positioned about a ball container for the handling and support of the container.

Referring to FIG. 1, there is shown a side elevational view of one embodiment of a container for retrieving and storing balls, which container is constructed in accordance with the principles of the present invention. A preferred embodiment of the invention, includes a container 10 comprising a pair of closed rectangular loops 11 and 12 forming the top and bottom peripheral frames of the container 10. Frame loops 11 and 12 are joined by a plurality of vertically extending rods 13 and 15 forming the side walls of the container 10. A pair of handles 21 and 22 upstand from said wall portions of the container 10 and are foldably connected thereto. A horizontal handle support rod 14 is fixed to the side rods 13 and 15 of the container 10 by welding to hingedly support the handles 21 and 22.

Figure 2:
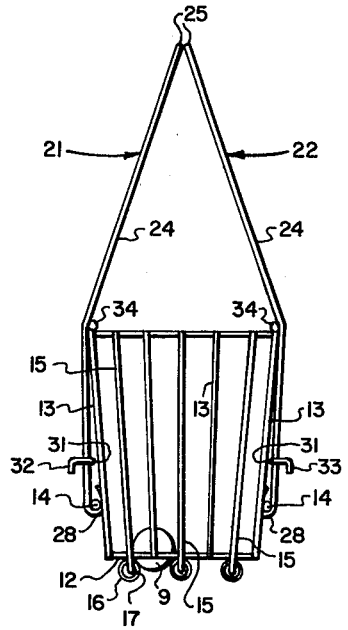
FIG. 2 is an end elevational view of the apparatus shown in FIG. 1.

Referring now to FIG. 2 it may be seen that vertically extending rod members 15 extend down the sides and across the bottom of the container 10. Rods 15 extend slightly below the bottom frame loop 12 and lie parallel to one another across the bottom of the container a distance from one another slightly greater than the diameter of a ball 9 to be retrieved and stored within the container 10. The embodiment shown in the drawings include three parallel rods 15 which are fixed only at their end portions at the hoop 12 and which are slightly resilient in a direction transverse to their length. Each of the rods 15 have journaled thereon for free rotational movement, a plurality of roller members 16. Each roller 16 is preferably formed from resilient materials such as plastic in a hollow, cylindrical configuration. A normally closed slit 17 may be provided along the length of one side. The rollers 16 may be formed by conventional extrusion, injection molding, or similar processes. The slit 17 is provided for installation and replacement of the rollers 16 onto the transverse bottom portions of the rods 15. The side walls of the rollers 16 are preferably of a thickness whereby the distance between the inside surfaces of adjacent rollers installed on the rods 15 is slightly less than the diameter of the ball to be retrieved. The resiliency of the rods 15 allow slight deformation of the spacing between said rods to receive a ball therebetween. The expanding action of the rollers 16 is necessary to assist in proper movement of the ball between adjacent rollers in a manner not to mar the surface of the ball.

Referring now to FIGS. 1 and 2 together, container 10 comprises handles 21 and 22 each of which includes a pair of upstanding rods 23 and 24 being joined across the top by a generally orthogonal handle portion 25. Handles 21 and 22 preferably include rounded corners 26 and 27 joining the side rods 23 and 24 to the handle portion 25. The end of the rods 23 and 24 opposite handle portion 25 terminates in connecting end portions 28 and 29. The end portions 28 and 29 are formed as hooks which loosely engage the handle support rod 14 to hingedly secure the handles 21 and 22 to the rod. The hooks 28 and 29 are preferably formed with an elongate shape to allow transverse as well as rotational movement as will be discussed in more detail below. Extending generally transversely across the side rods 23 and 24 and spaced generally equidistant from the hooks 28 and 29 is a handle support strut 31 having a pair of down turned catches 32 and 33 at each end. Finally, each handle includes a transversely extending stabilizer arm 34 located at approximately the mid portion thereof to render structural rigidity to the handles 21 and 22.

FIGS. 1 and 2 illustrate the handles 21 and 22 in an upwardly extended position for the transportation of the ball container 10 and/or for use by an operator in a ball retrieval function. In this configuration, it may be seen that the handle rods 25 are positioned adjacent to one another for ease of gripping. As shown most clearly in FIG. 2, the handle portions 25 may also be interlocked with one another by virtue of one handle portion being slightly shorter and positionable within the adjacent handle.

Figure 3:
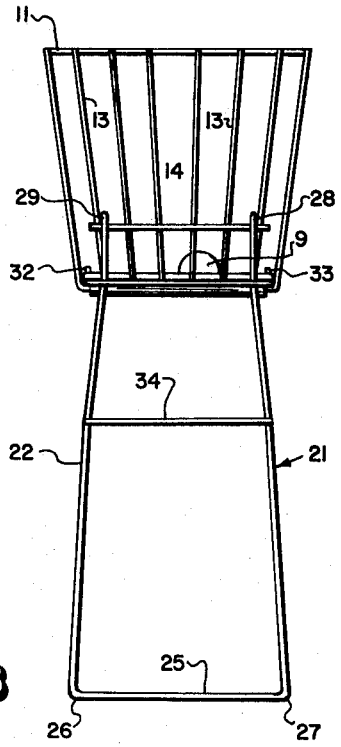
FIG. 3 is a side elevational view of the retrieving container of the present invention with the folding handles positioned downwardly in support of the container.
Figure 4:
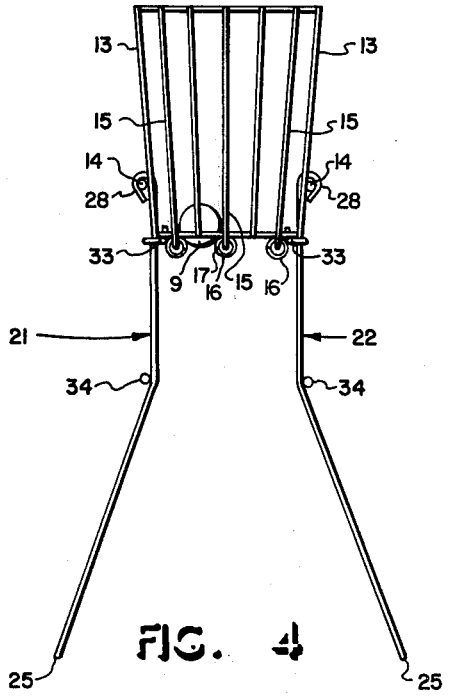
FIG. 4 is an end elevational view of the retrieving container of the present invention shown in FIG. 3.

Referring now to the FIGS. 3 and 4, it may be seen that the handles 21 and 22 of the present invention may be folded into a downwardly extending position by pulling the handles outwardly and downwardly. In this manner the hooks 28 and 29 pivot about the transverse handle support rods 14. The elongate shape of hooks 28 and 29, as seen in FIGS. 2 and 4, permit the container 10 to shift upwardly and downwardly relative to the depending handles 21 and 22. This loose tolerance of the fit between the hooks 28 and 29 and the rod 14 allows the catches 32 and 33 to extend beneath and hook back into the bottom peripheral ring 12 of the container 10 in the "standing" position of FIGS. 3 and 4. As perhaps best shown in FIG. 4, when the container 10 is settled down onto the downwardly extending handles 21 and 22, the catches 32 and 33 put the handles into rigid engagement with the container, whereby the handles become a convenient stand for supporting the container at a height of approximately a player's hip. In this configuration the balls may be easily removed from the open top of the container for successive use in play and/or practice.

Referring again to FIGS. 1 and 2, attention is drawn to the bottom structure of the container 10. As shown most clearly in FIG. 2, the bottom structure includes a plurality of parallel spaced apart rod members 15. These rod members are spaced from one another a distance greater than the diameter of the balls to be retrieved. Positioned on each of the rod members 15 is an elongated cylindrical roller member 16. A slit 17 is provided down the side of roller member 16 for positioning the roller about the rod after fabrication of the container 10 and for replacement of worn rollers. The cylindrical roller 16 is preferably formed of a resilient synthetic material that will not mar or scratch the playing surface of a playing field such as a tennis court. In addition, the rollers 16 are preferably disposed about the rods 15 in a fairly loose manner so that they may easily rotate and shift in respect to one another. This construction greatly facilitates the ingress of balls 9 through the bottom of container 10 and prevents their egress after retrieval despite the weight of additional balls positioned above it. The rotation of roller 16 may also be seen to allow the ball 9 to pass through the bottom without dragging across stationary bars which in some cases can be deleterious to the surface of the ball. The roller 16 thus serves as a positive ball ingress element.

Figure 5:
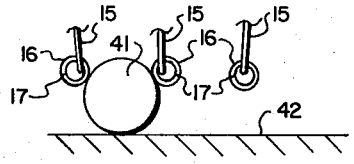
FIG. 5 is an enlarged, fragmentary, illustrative end view of the bottom of the container of FIG. 2, being used to retrieve tennis balls from an underlying surface.
Figure 6:
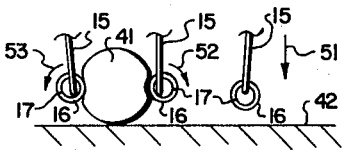
FIG. 6 is a view of the container of FIG. 5 with the ball being positioned intermediate of rollers in retrieval, thereof.
Figure 7:
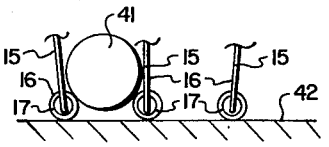
FIG. 7 is a view of the container of FIG. 6 with the ball is fully positioned within the container showing the manner in which the rollers coact with the surface from which the ball is being retrieved.

Referring now to FIGS. 5, 6 and 7 in combination we observe the particular function of the rollers 16 with respect to the ball retriever motion. A ball 41 is shown positioned upon the upper playing surface such as a tennis court 42. In FIG. 5, the container 10 is first placed down on the ball 41 to be retrieved. The distance between facing surfaces of adjacent rollers 16 is generally slightly less than the diameter of the ball 41. As rollers 16 contact the ball, their loose fit upon the rods 15 allows the surfaces of the rollers to separate slightly further apart. As the container is pressed further down upon the ball, the transversely resilient rods 15 and rollers 16 flex slightly so that the outer surfaces of the rollers 16 rotate with the movement of the outer periphery of the ball 41 between the rollers 16 and reduce the resistance to ball ingress which is of particular consideration when the container 10 is full of balls.

In FIG. 6, the ball 41 is passing between adjacent rollers 16. The container 10, moving in the direction of arrow 51, thus causes rotation of rollers 16 in the direction of arrows 52 and 53. This rotation is effected in conjunction with flexing of the rods 15. In FIG. 7 the ball 41 has been fully retrieved. As is shown the container comes to rest on the upper surface 42 of the playing court with the rollers 16 in direct engagement with the surface. Since the rollers are made of a synthetic, resilient material, engagement of the rollers with the surface 42 is non-abrasive. Regardless of the repeated usage and repeated engagement of the rollers with the playing surface, the configuration of the invention produces no abrasion of the surface and consequently no scarring or marring effects to the surface.

As will also be noted with respect to FIG. 7, once the tennis ball 41 is positioned within the container the spacing between inside surfaces of adjacent rollers 16 is slightly less than the diameter of the ball 41. In this manner the weight of the ball 41 alone or in combination with a plurality of additional balls will not be surficient to cause the rollers to part from one another so as to allow the balls to fall from the container 10. The rollers 16 also provide the feature of replacement. When repeated usage causes the roller 16 to become worn, it can be easily replaced. Prior art designs with fixed rods cannot be so easily replaced. This aspect is an important consideration since the retrieval action of the container 10 necessitates repeated abutting engagement of the container bottom against the underlying playing surface. The metal frames of many prior art designs are also welded in such a fashion that the stresses produced from the ball retrieval function causes fatigue failure in the weld. The stresses produced in the present invention are distributed by the rollers 16 across the rods 15 which are spaced apart a distance greater than the balls to be retrieved. This spacing and the roller rotation minimizes the susceptibility of fatigue failure in the container 10 structure.

Figure 8:
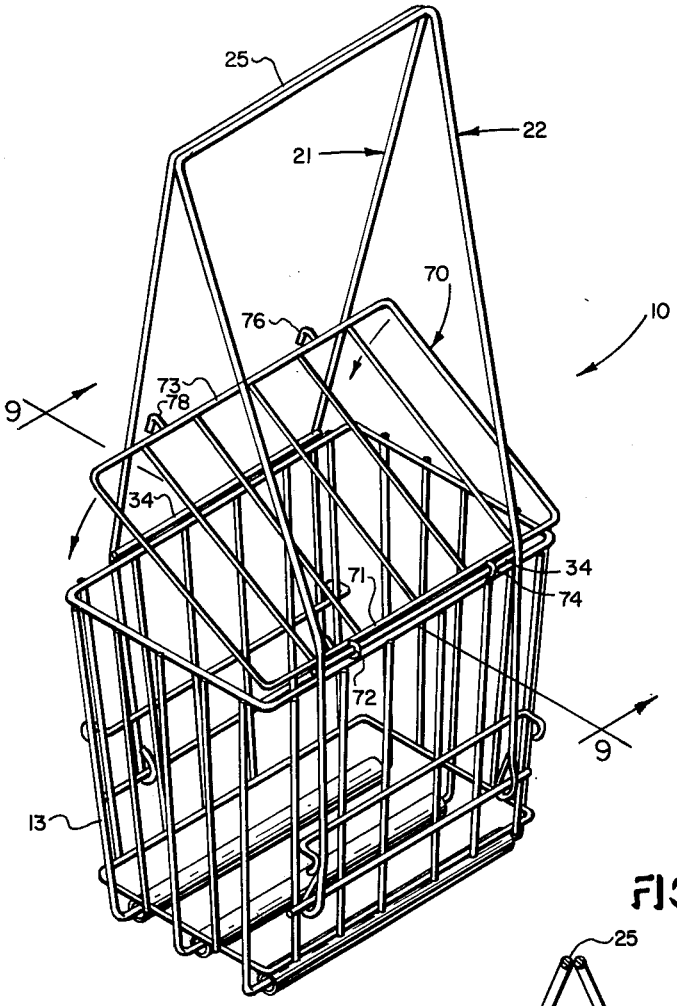
FIG. 8 is a perspective view of an alternative embodiment of the present invention, illustrating closure means across the top of the container.

Referring now to FIG. 8, there is shown an alternative embodiment of the apparatus of the present invention. Container 10 is shown with a top closure means or hinged panel 70. The transversely extending stabilizer arm 34 of handle 22 on one side of the container 10 has hingedly mounted thereon a first end 71 of the panel 70. A pair of loop members 72 and 74 of the panel end 71 is shown engaging stabilizer arm 34. The opposite end 73 of the panel 70 includes a pair of fastening fingers 76 and 78 which snap over the opposite stabilizer arm 34 of handle 21 in the closed position.

Figure 9:
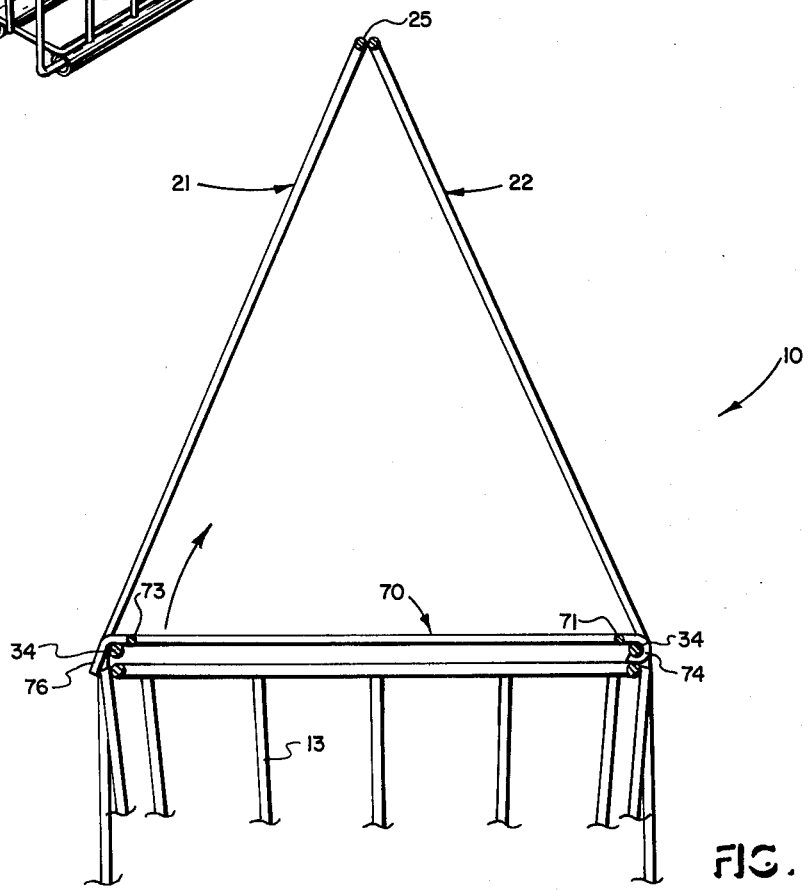
FIG. 9 is an enlarged, cross section view of the apparatus of FIG. 8 taken along lines 9—9 thereof.

Referring now to FIG. 9, the panel 70 is shown in the closed position across the container 10. The fingers 76 and 78 thus secure opposite arms 34 of handles 21 and 22, one to the other. In this position balls within the containers are securely contained and the handles 21 and 22 are locked in a carrying position. This aspect of the invention facilitates the use of the container 10 by providing improved means for securing the handles 21 and 22 in the carrying position. Similarly, when the container 10 is set upon a surface, the handles 21 and 22 are prevented from falling to one side. In the standing poistion of FIGS. 3 and 4 the optional panel 70 simply lies upon side rods 23 and 24.

It is thus believed that the operation and construction of the present invention will be apparent from the foregoing description. While the method and apparatus shown and described has been characterized as being preferred it will be obvious that various changes and modifications may be made therein without departing from the spirit and scope of the invention as defined in the following claims.

What is claimed:

1. A tennis ball retrieving apparatus for receiving tennis balls from a playing surface and storing said balls for subsequent use, said apparatus comprising:

a container having an open top, side and end walls, and a bottom including a plurality of parallel rods spaced from one another a distance greater than the diameter of a ball to be retrieved;

a pair of cylindrical rollers formed of a resilient material which will not mar a tennis ball playing surface upon frictional engagement therewith, each of said rollers being positioned loosely about each of the bottom rods for movement upon the rods and having a wall-thickness sufficient to prevent contact between the bottom of the container and the playing surface, the spacing between opposing inside surfaces of adjacent ones of said rollers being slightly less than the diameter of a ball to be retrieved and stored within the container;

means for supporting said container above balls resting on a playing surface for the forced manipulation of said container downwardly over said balls and the passage of said balls between adjacent ones of said rollers for retrieval; and a pair of handles hingedly mounted to opposite side walls of said container for rotating between an upwardly and downwardly extending position, wherein said handles include elongated hook portions which hingedly connect to said container side walls for allowing transverse and rotational movement relative to said container, and wherein each of said handles further includes at least one hook member disposed upon said handle for engaging and securing said container through transverse movement of said handle relative to said container and the upstanding support thereof when said handle is in a downwardly rotated position.

2. A tennis ball retrieving apparatus for receiving tennis balls from a playing surface and storing said balls for subsequent use, said apparatus comprising:

a container having an open top, side and end walls, and a bottom including a plurality of parallel rods spaced from one another a distance greater than the diameter of a ball to be retrieved;

a pair of cylindrical rollers formed of a resilient mateial which will not mar a tennis ball playing surface upon frictional engagement therewith, each of said rollers being positioned loosely about each of the bottom rods for movement upon the rods and having a wall-thickness sufficient to prevent contact between the bottom of the container and the playing surface, the spacing between opposing inside surfaces of adjacent one of said rollers being slightly less than the diameter of a ball to be retrieved and stored within the container;

means for supporting said container above balls resting on a playing surface for the forced manipulation of said container downwardly over said balls and the passage of said balls between adjacent ones of said rollers for retrieval;

a pair of handles hingedly mounted to opposite side walls of said container for rotating between an upwardly and downwardly extending position; and a rigid top panel member formed of parallel rods for substantially enclosing balls within the container, said panel member being hingedly connected to one of said handles and adapted for engaging the other of said handles and to securing said handles in an upright position when said panel member is in a closed position across said container.

* * * * *